US009305536B2

(12) United States Patent
Cuylits

(10) Patent No.: US 9,305,536 B2
(45) Date of Patent: Apr. 5, 2016

(54) BAG FOR INSERTION INTO A CAVITY OF A SILENCER, WHICH CAVITY IS INTENDED FOR SOUND DAMPING

(71) Applicant: CUYLITS HOLDING GMBH, Bersenbrueck (DE)

(72) Inventor: Diederik Cuylits, Bersenbrueck (DE)

(73) Assignee: CUYLITS HOLDING GMBH, Bersenbrueck (DE)

( * ) Notice: Subject to any disclaimer, the term of this patent is extended or adjusted under 35 U.S.C. 154(b) by 0 days.

(21) Appl. No.: 14/427,472

(22) PCT Filed: Sep. 18, 2013

(86) PCT No.: PCT/EP2013/069345
§ 371 (c)(1),
(2) Date: Mar. 11, 2015

(87) PCT Pub. No.: WO2014/044698
PCT Pub. Date: Mar. 27, 2014

(65) Prior Publication Data

US 2015/0235636 A1 Aug. 20, 2015

(30) Foreign Application Priority Data

Sep. 18, 2012 (DE) ..... 10 2012 018 371
Sep. 20, 2012 (DE) ..... 20 2012 103 599 U

(51) Int. Cl.
*F01N 1/24* (2006.01)
*G10K 11/00* (2006.01)

(52) U.S. Cl.
CPC ..... *G10K 11/002* (2013.01); *Y10T 29/4957* (2015.01)

(58) Field of Classification Search
CPC ..... F01N 1/10; F01N 1/24
USPC ..... 181/256
See application file for complete search history.

(56) References Cited

U.S. PATENT DOCUMENTS

| | | | | |
|---|---|---|---|---|
| 4,421,202 | A * | 12/1983 | Hoy | 181/252 |
| 5,036,585 | A * | 8/1991 | Schweinfurth | 29/890.08 |
| 6,068,082 | A * | 5/2000 | D'Amico et al. | 181/256 |
| 6,319,444 | B1 * | 11/2001 | Kirk | 264/136 |
| 6,457,555 | B1 * | 10/2002 | Saughnessy | 181/294 |
| 6,581,723 | B2 * | 6/2003 | Brandt et al. | 181/256 |
| 6,585,078 | B2 * | 7/2003 | Curtice et al. | 181/252 |
| 6,607,052 | B2 * | 8/2003 | Brandt et al. | 181/256 |

(Continued)

FOREIGN PATENT DOCUMENTS

| | | |
|---|---|---|
| FR | 2906307 A1 | 3/2008 |
| GB | 2267731 A | 12/1993 |

(Continued)

OTHER PUBLICATIONS

International Search Report for PCT/EP2013/069345 dated Jan. 8, 2014.

*Primary Examiner* — Forrest M Phillips
(74) *Attorney, Agent, or Firm* — Cohen & Hildebrand, PLLC

(57) ABSTRACT

The invention relates to a bag (1) for insertion into a cavity of a silencer, which cavity is intended for sound damping or absorption, having a cover (2) which is closed on all sides and having a sound-damping or sound-absorbing filling (3). It is provided according to the invention that the cover consists of glass fibers and the filling is blown into the interior of the bag through the cover of the bag.

28 Claims, 1 Drawing Sheet

(56) References Cited

U.S. PATENT DOCUMENTS

| | | | | |
|---|---|---|---|---|
| 7,165,648 | B2 * | 1/2007 | Arsdale | 181/256 |
| 8,985,270 | B2 * | 3/2015 | Daniszewski | 181/256 |
| 2003/0019688 | A1 * | 1/2003 | Takewaka et al. | 181/252 |
| 2010/0263762 | A1 * | 10/2010 | Callahan et al. | 138/149 |

FOREIGN PATENT DOCUMENTS

| | | | | |
|---|---|---|---|---|
| JP | 62038817 | A * | 2/1987 | F01N 7/14 |
| WO | 2005049982 | A1 | 6/2005 | |

* cited by examiner

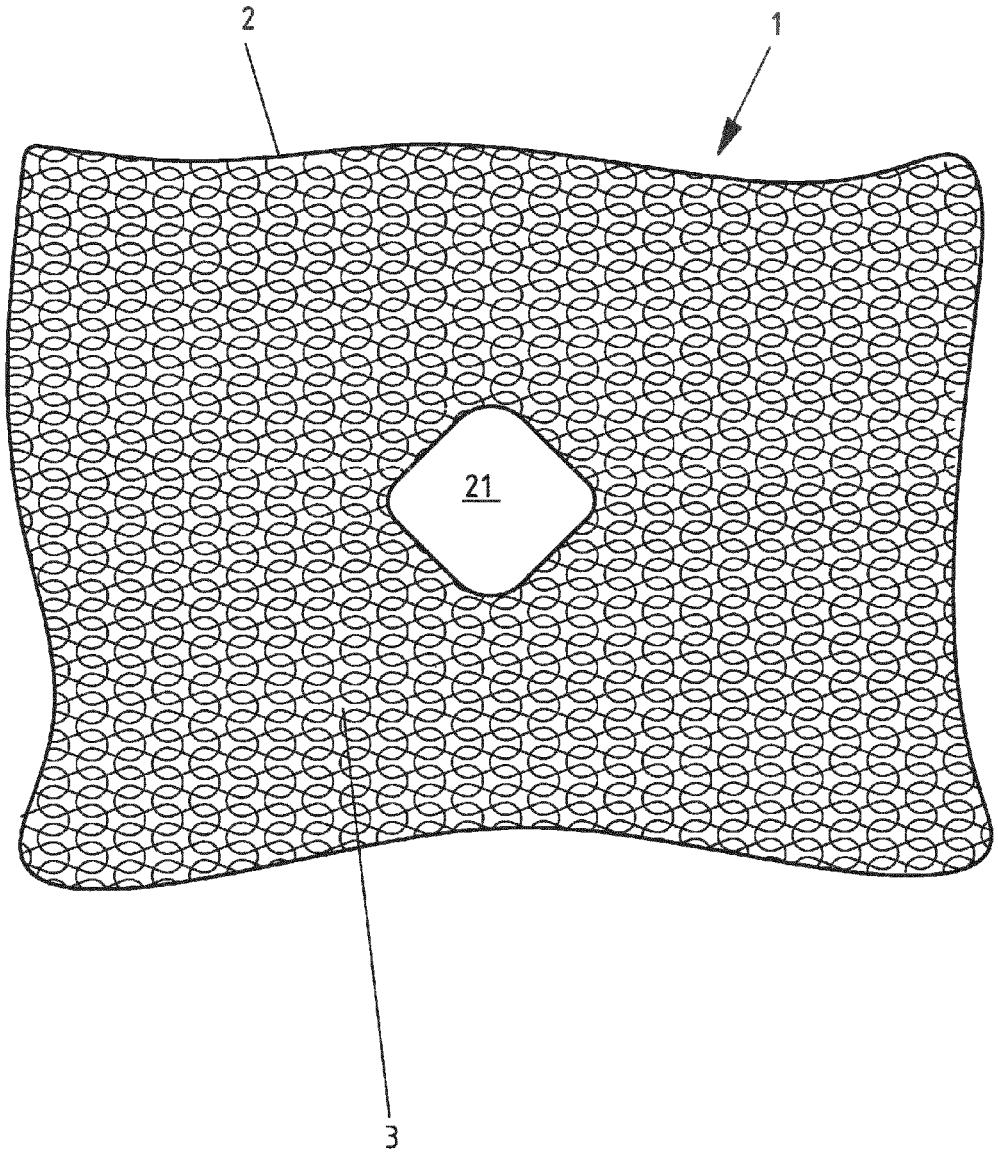
2
1
21
3

BAG FOR INSERTION INTO A CAVITY OF A SILENCER, WHICH CAVITY IS INTENDED FOR SOUND DAMPING

This is an application filed under 35 USC §371 of PCT/EP2013/069345 filed on Sep. 18, 2013, claiming priority to DE 10 2012 018 371.2 filed on Sep. 18, 2012 and to DE 20 2012 103 599.5 filed on Sep. 20, 2012.

BACKGROUND OF THE INVENTION

The invention relates to a bag for insertion into a cavity of a silencer intended for sound damping, a set of such bags, a silencer with such bags and corresponding methods for making the aforementioned.

A silencer is a device for reducing sound emissions. Various types of silencers exist, which reduce the generated sound power based on different mechanisms of action. An absorption silencer contains porous material, usually rock wool, glass wool or glass fibers, which partially absorbs the sound energy, i.e. converts it into heat. The effect of sound absorption is amplified by the multiple reflections. The invention relates particularly to such silencers. Such silencers for internal combustion engines, especially for passenger cars or trucks, have a perforated inner tube for the passage of the exhaust gases. This inner tube is routed in a cover impervious to air, dirt and moisture, thus forming a cavity is between the inner tube and the cover. This cavity is filled with a sound-damping or sound-absorbing filling, which must be heat-resistant. Since filling the cavity is complicated, prefabricated flexible or more or less rigid elements with a sound-absorbing filling are used instead.

For example, dimensionally stable molded parts constructed from glass fibers, basalt wool and multiple components are known which contain flammable components for shape retention, which burn at the first use of the silencer.

Bags are known for insertion into a cavity of a silencer intended for sound damping or absorption with a completely enclosed cover, with a sound-damping or sound-absorbing filling, wherein the cover is composed of plastic films or webs, which are welded after filling.

WO 2005/049982 discloses a bag for insertion into a cavity of a silencer intended for sound damping or sound absorption with a knitted tubular cover and a sound-damping or sound-absorbing filling, wherein the cover is made of glass fibers. The filling is introduced into the cover which is then closed at its respective ends. It is not disclosed to produce certain 3D shapes.

DE 203 05 409 U discloses a bag for insertion into a cavity of a silencer intended for sound damping or sound absorption having a tubular non-heat resistant cover and a sound-damping or sound-absorbing filling. The filling is introduced into the cover which is then closed at its respective ends. It is not disclosed to produce certain 3D shapes. The cover combusts during the operation of the silencer.

U.S. Pat. No. 6,068,082 discloses a grid-like element for insertion into a cavity of a silencer intended for sound damping or sound absorption having a heat-resistant cover and with a sound-damping or sound-absorbing filling. The filling is introduced into the cover, whereafter the cover is sealed.

GB 2 267 731 discloses a flexible bag for insertion into a cavity of a silencer intended for sound damping or sound absorption with a fusible cover and a sound-damping or sound-absorbing filling. It is disclosed, among other things, to place the bag around the inner tube of the silencer.

BRIEF SUMMARY OF THE INVENTION

It is an object of the invention to provide an improved bag for insertion into a cavity of a silencer and a silencer equipped with such a bag.

This object is attained with a bag having the features of the independent claim. A set of such bags, a silencer with such bags and corresponding method for producing the aforementioned are the subject of the other independent claims.

Advantageous embodiments are the subject matter of the dependent claims.

As already known from the prior art, the proposed bag for insertion into a cavity of a silencer intended for sound damping or sound absorption foremost includes an cover closed on all sides, with a sound-damping or sound-absorbing filling enclosed therein. The term closed cover within the context of the invention is to be understood not as a sealed, for example, water-, dirt- or pressure-proof cover, such as a film. The term "closed" only indicates that the cover is impervious to the filling housed therein during transport, during normal use as well as during insertion into the cavity of the silencer in the production of the silencer. The particularity of the invention is hereby that the cover consists of fiberglass and that the filling is blown through the cover of the bag into the interior of the bag. Thus, it is possible for the first time to provide a compact filling for labor-saving insertion into the cavity of a silencer, which does not release toxic combustion gases when the silencer is first used. Fewer process steps are required in the production of the bag because of the bag does no longer need to be closed after the filling.

According to another aspect of the invention, which can be implemented independently or in conjunction with the aforedescribed invention, the cover of the generic bag which is closed on all sides has passages. This allows adaptation to the geometry inside the cavity, for example on indentations. The aforementioned passage in the cover is thus able to accommodate the indentations, thus obviating the need for manual adjustment by pressing- in/inserting individual bags. Preferably, however, the passage is adapted to the external cross section of the inner pipe of the silencer. The bags can then be easily slipped over the inner tube. Conversely, in the prior art, it was necessary to wrap individual bags around the inner tube or to place several bags around the inner tube. This aspect of the invention can be implemented independent of the material used for the cover, i.e. even with the aforementioned conventional bags made, for example, of plastic.

The following advantageous embodiments apply for both inventions:

A stretchable and shapeable cover results when the cover consists essentially of intermeshed glass fibers, in particular a knitted fiberglass fabric. This construction has the advantage, inter alia, that closed covers that do not need to be welded, stitched or sealed, can be produced in a single process. One feature is therefore that the cover lacks seams. Knitted fabric refers here to two-dimensional textile structures, wherein a mesh formed by a thread that is looped through another mesh. The resulting loops can be formed using one or more threads.

The mesh size or mesh dimensions of the glass fibers should therefore be selected such that the components of the filling can initially be easily blown in through a mesh of the cover, whereas after the components are blown in, the filling which then typically has a greater volume, is then prevented from falling out through the mesh.

The mesh size is therefore preferably 2-9 mm, in particular from 2.5-5 mm, and even more preferably 3 mm.

Preferably, the cover which is closed on all sides is produced by a single process, in particular by knitting, preferably on a flat knitting machine. Flat knitting machines enable the production of complex structures, for example sweaters or closed bag. Furthermore, threads having an even greater temperature resistance may be used in the knitting operation at desired locations. Conventional fiberglass covers are produced on circular knitting machines and are therefore limited to tubular shapes and must be closed manually or at an additional step.

When the cover has a shape adapted to the cavity, the cavity is particularly compactly filled with the filling without requiring labor intensive plugging, adjusting and/or pressing. Therefore, the cover can advantageously have cross-sections that vary along its length, width and/or height, in particular steps, curves, bulges, constrictions and/or indentations. Only comparatively simple, tubular or pillow-like shapes were previously known in the art.

Preferably, the filling consists entirely or partly of refractory rovings, fibers or yarns. These allow the preferred blowing into the closed cover of the bag according to the invention. Roving refers to a bundle, strand, or multifilament yarn of parallel filaments (continuous filaments), which is used mainly in the production of fiber-composite plastics (FCP) or fiber-reinforced plastics, a subset of composite materials. The cross-section of a roving is generally elliptical or rectangular. However, rovings with a slight protective twist (for example, 10 turns/m) also exist, which produces a rounder cross-section. Most frequently, filaments made of glass, aramid or carbon are combined into ravings. These can be easily blown in, for example through a mesh of the cover, with their volume increased after being blown in, so that they are prevented from falling through the mesh.

Because of their considerable heat resistance, the filling preferably consists of glass or basalt materials. Preferably, the cover and/or the filling are heat-resistant in the range of 400-1300° C., preferably 450-1100° C. The employed materials are preferably E-glass, silica, fiberglass with SiO2 content greater than 75% ECR glass, S-glass, and C-glass.

Preferably, the shape of the bag is adapted to the cavity of a silencer so that the cavity can be well filled without requiring manual plugging or fitting.

It is also proposed to provide a set of the aforedescribed bags, with shapes of the bags configured so that they together can fill the cavity of a silencer. Like a puzzle, each bag has its predetermined location and is adapted to this bag and the adjacent bag. Therefore, the fillings can be inserted labor-saving under restricted conditions, for example with undercuts. For this purpose, each bag has preferably a shape adapted to a particular area of the cavity.

Furthermore, a complete silencer is claimed which uses the bags made according to the above teachings. This silencer, in particular for internal combustion engines, preferably for passenger cars or trucks, has a perforated inner tube for passing through exhaust gases, a cover impervious to air, dirt and moisture, and a cavity formed between the inner tube and the cover. Preferably, one or more bags are arranged in the cavity, whereby in particular the cavity is completely filled. Furthermore, one or more bags with passages may be arranged in the cavity, wherein the inner tube extends through the passage in the cover.

The method according to the invention for producing the aforedescribed bag includes the following steps in the order indicated:

Producing the cover which is closed on all sides from glass fibers by a single process, in particular knitting, preferably on a fiat knitting machine, preferably in the absence of stitching;

Blowing a sound-damping or sound-absorbing filling through the cover of the bag into the interior of the bag.

This approach eliminates a separate step for stitching the bag after introducing the filling.

The method according to the invention for producing a silencer includes the following steps:

Carrying out the aforedescribed method for producing a bag

Inserting the bag into the cavity formed between the inner pipe and the cover of the silencer, in particular to the predetermined location for the respective bag, to which the shape of the bag is adapted.

BRIEF DESCRIPTION OF THE DRAWINGS

Other advantages will become apparent from the following description and the accompanying FIGURE. The aforementioned and further described features can each be used according to the invention individually or in any combination with one another. The aforementioned exemplary embodiments are not intended to be exhaustive and are only exemplary.

DETAILED DESCRIPTION OF THE INVENTION

FIG. 1 shows the bag 1 according to the invention for insertion into a cavity of a silencer intended for sound damping or sound absorption. The fiberglass cover 2 which is closed on all sides is produced in a single process on a flat knitting machine and was not stitched. A sound-damping or sound-absorbing filling 3 is disposed inside the cover 2. This filling 3 was blown into the interior of the bag through the cover, i.e. through a mesh of the fabric forming the cover.

The fully enclosed cover 2 has on the inside a passage 21 for pushing through the inner tube of the silencer. Therefore, the diameter of the passage 21 is adapted to the outer cross-section of the inner tube of the silencer.

The invention claimed is:

1. A bag insertable into a cavity of a silencer for sound damping or sound absorption, the bag comprising:

a mesh cover closed on all sides to form the bag, wherein the mesh cover consists essentially of intermeshed glass fibers, and a sound-damping or sound-absorbing filling blowable into an interior of the bag through the mesh cover of the bag.

2. The bag according to claim 1, wherein the mesh cover which is closed on all sides comprises a passage defined therethrough.

3. The bag according to claim 1, wherein a mesh size of the intermeshed glass fibers is 2-9 mm.

4. The bag according to claim 1, wherein the mesh cover is free of seams.

5. The bag according to claim 1, wherein the mesh cover which is closed on all sides is manufactured by a single process.

6. The bag according to claim 1, wherein the mesh cover has a shape adaptable to the cavity.

7. The bag according to claim 1, wherein the filling comprises heat-resistant rovings, fibers or yarns.

8. The bag according to claim 1, wherein the filling material is one of the following: E-glass, silica, glass fibers with SiO2 content greater than 75%, ECR-glass, S-glass, and C-glass.

9. The bag according to claim 1, wherein the bag has a shape that is adaptable to the cavity of a silencer.

10. The bag according to claim 1, wherein the intermeshed glass fiber is a fiberglass fabric.

11. The bag according to claim 2, wherein the passage (21) is adapted to receive therethrough an inner tube of the silencer.

12. The bag according to claim 3, wherein the mesh size of the intermeshed glass fibers is 2.5-5 mm.

13. The bag according to claim 3, wherein the mesh size of the intermeshed glass fibers is 3 mm.

14. The bag according to claim 5, wherein the mesh cover is knitted.

15. The bag according to claim 14, wherein the mesh cover is knitted by a knitting machine.

16. The bag according to claim 6, wherein the mesh cover is adapted to cross-sections of the cavity that vary over a length, width and/or height of the cavity.

17. The bag according to claim 6, wherein the mesh cover is adapted to steps, curves, bulges, constrictions and/or indentations of the cavity.

18. The bag according to claim 7, wherein the heat-resistant rovings, fibers or yarns is made of glass or basalt.

19. The bag according to claim 7, wherein the mesh cover and/or the is heat-resistant in a range of 400-1300° C.

20. The bag according to claim 19, wherein the mesh cover and/or the filling is heat-resistant in a range of 450-1100° C.

21. A silencer comprising:

a perforated inner tube for passing therethrough exhaust gases, a mesh cover impervious to air, dirt and moisture, a cavity formed between the inner tube and the cover, at least one bag arranged in the cavity, wherein the at least one bag comprises:

a mesh cover closed on all sides, wherein the mesh cover consists essentially of intermeshed glass fibers, and a sound-damping or sound-absorbing filling disposed inside the mesh cover, wherein the filling is blowable into an interior of the bag through the mesh cover of the at least one bag.

22. The silencer according to claim 21, wherein more than one bag is arranged in the cavity.

23. The silencer according to claim 21, wherein the inner tube extends through a passage formed in the mesh cover.

24. A method of producing a bag including: a mesh cover closed on all sides, wherein the mesh cover consists essentially of intermeshed glass fibers; and a sound-damping or sound-absorbing filling disposed inside the mesh cover, the method comprising the steps of:

Producing the mesh cover from the intermeshed glass fibers in the absence of welding, stitching or sealing;

Blowing the sound-damping or sound-absorbing filling through the mesh cover into an interior of the bag.

25. A method for manufacturing a silencer including: a perforated inner tube for passing therethrough exhaust gas; a mesh cover impervious to air, dirt and moisture; and at least one bag; wherein the at least one bag impervious to air, dirt and moisture; and at least one bag; wherein the at least one bag includes: a mesh cover closed on all sides, the mesh cover consisting essentially of intermeshed glass fibers; and a sound-damping or sound-absorbing filling disposed inside the at least one bag, the method comprising the steps of:

Producing the mesh cover from the intermeshed glass fibers in the absence of welding, stitching or sealing;

Blowing the filling through the mesh cover into the interior of the bag;

Inserting the bag into a cavity formed between the inner tube and the mesh cover.

26. The silencer according to claim 21, wherein, wherein the cavity is completely filled by the at least one bag.

27. The silencer according to claim 22, wherein the cavity is completely filled by the more than one bag.

28. The silencer according to claim 27, wherein each of the more than one bag is adaptable in shaped to a particular area of the cavity.

* * * * *

UNITED STATES PATENT AND TRADEMARK OFFICE

CERTIFICATE OF CORRECTION

PATENT NO. : 9,305,536 B2
APPLICATION NO. : 14/427472
DATED : April 5, 2016
INVENTOR(S) : Diederik Cuylits It is certified that error appears in the above-identified patent and that said Letters Patent is hereby corrected as shown below:

In the claims,

Col. 5, claim 11, line 1, delete "(21)".

Col. 5, claim 19, line 2, after "the", insert --filling--.

Col. 6, claim 25, line 4, delete "wherein the at least one bag impervious to air, dirt".

Col. 6, claim 25, line 5, delete "and moisture; and at least one bag;".

Col. 6, claim 26, line 1, delete ", wherein" (first occurrence).

Col. 6, claim 28, line 2, change "shaped" to --shape--.

Signed and Sealed this
Twelfth Day of July, 2016

Michelle K. Lee

Michelle K. Lee
*Director of the United States Patent and Trademark Office*